US005660572A

United States Patent [19]

Buck

[11] Patent Number: 5,660,572

[45] Date of Patent: Aug. 26, 1997

[54] FLOTATION FABRIC AND LIFE PRESERVER MADE THEREFROM

[76] Inventor: William M. Buck, 4091 Cypress Reach Ct., Apt. 401, Bldg. 152, Pompano Beach, Fla. 33069

[21] Appl. No.: 620,351

[22] Filed: Mar. 22, 1996

[51] Int. Cl.[6] ..... B63C 9/11

[52] U.S. Cl. ..... 441/106; 441/107

[58] Field of Search ..... 441/102, 103, 441/106, 114–119, 129, 107; 5/911

[56] References Cited

U.S. PATENT DOCUMENTS

| | | | |
|---|---|---|---|
| 3,459,179 | 8/1969 | Olesen | 5/911 |
| 3,813,279 | 5/1974 | Varner | 161/127 |
| 3,867,236 | 2/1975 | O'Link | 441/106 |
| 3,881,439 | 5/1975 | Svanholm | 114/69 |
| 4,027,888 | 6/1977 | Wilcox | 5/911 |
| 4,304,824 | 12/1981 | Karpinski | 428/69 |
| 4,619,622 | 10/1986 | Mcdonald et al. | 441/106 |
| 4,693,691 | 9/1987 | DeYoe | 441/129 |
| 5,184,968 | 2/1993 | Michalochick | 441/106 |

OTHER PUBLICATIONS

Expandable PS Foam Molding by J.E. Shannon p. 254 From Modern Plastics Encyclopedia, 1989 McGraw Hill.

*Primary Examiner*—Sherman Basinger
*Attorney, Agent, or Firm*—Alvin S. Blum

[57] ABSTRACT

A flotation fabric is composed of two opposed layers of water permeable flexable woven or knitted material. Sandwiched between the layers are small particles, pellets or beads of closed cell foam plastic material. The cloth layers are joined together by stitching, heat sealing or adhesive to trap and flexibly immobilized the pellets between the layers to form a breathable flexible flotation fabric. Personal flotation devices or garments such as T shirts are made from the fabric. They are light weight, flexible, breathable and comfortable enough to be worn by a child at play and will allow a child to return to the surface and cry out for help to prevent drowning if the child falls in a body of water.

17 Claims, 1 Drawing Sheet

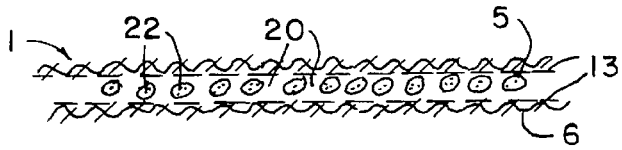
FIG. 3
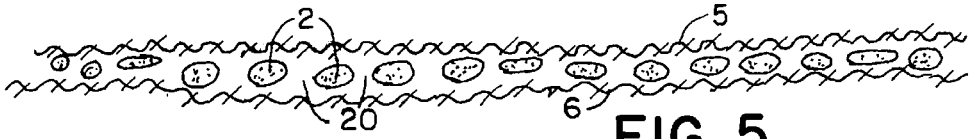
FIG. 5
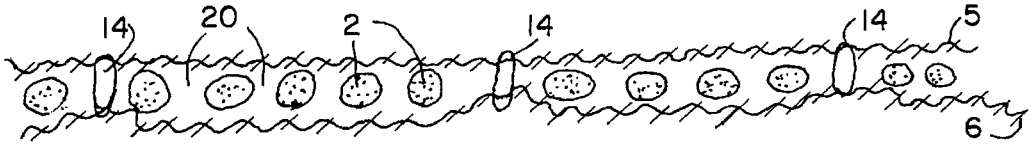
FIG. 6
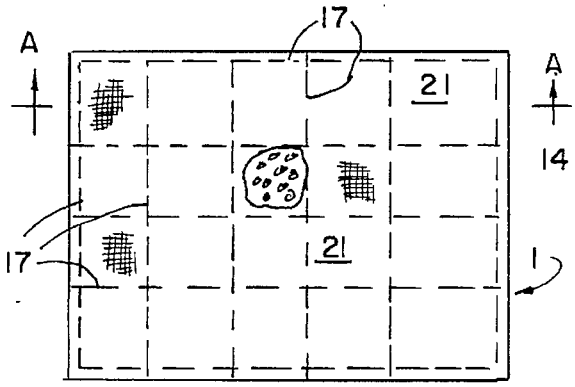
FIG. 4
FIG. 7
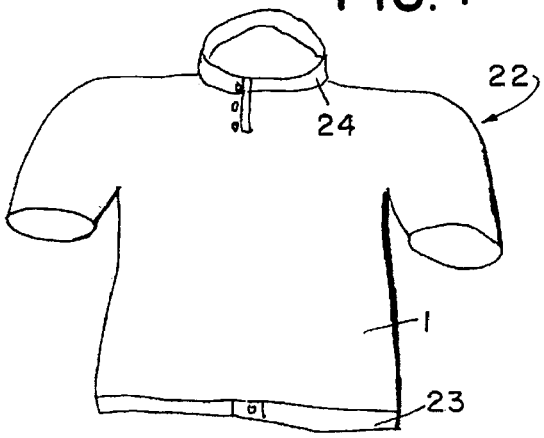
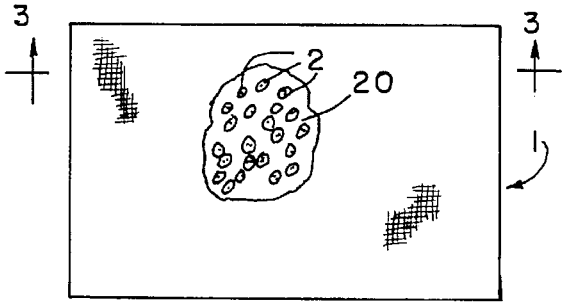
FIG. 2
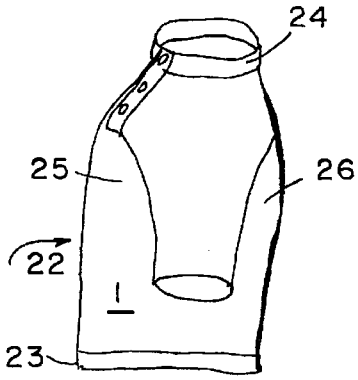
FIG. 8
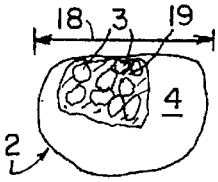
FIG. 1

FLOTATION FABRIC AND LIFE PRESERVER MADE THEREFROM

TECHNICAL FIELD

This invention relates to specially constructed fabrics having flotation properties and personal flotation devices fabricated therefrom especially designed for child safety.

BACKGROUND OF THE INVENTION

Personal flotation devices (PFD's), also known as life preservers, are designed to keep the wearer afloat at sea with the head sufficiently above water to enable breathing even in heavy seas. These are bulky and uncomfortable. They generally are made by sandwiching a very low density material such as closed cell foam, cork, or fiber such as kapok between waterproof layers of film or fabric.

In active play when a child perspires, these structures are so moisture impermeable that they do not permit the moisture to evaporate. They are so bulky and inflexible that they restrict a child's activity. Consequently, it is not surprising to find that children at play near dangerous waters do not wear a PFD.

Children at play near swimming pools, ponds and waterways cannot be supervised at all times, and cannot be expected to avoid the dangers. They may even overcome obstacles such as fences and doors intended to protect them.

Too many children drown as a result of this combination of circumstances. It would be desirable to provide children with a comfortable garment that they could wear at play that would keep them afloat if they should fall in the water.

SUMMARY OF THE INVENTION

It is, accordingly, an object of the invention to provide a comfortable garment that a child can wear at play that will be flexible, comformable and breathable while providing sufficient flotation to keep a child afloat until rescue can be affected.

The garment of the invention relies upon a unique flotation fabric for its desirable properties. The flotation fabric of the invention comprises a substantial volume of preexpanded plastic beads such as polystrene beads that are sandwiched between two layers of water permeable fabric.

The fabric may be a woven fabric such as cotton, or synthetic fiber or combinations thereof. The beads are flexibly immobilized between the layers by stitching, cementing or the like. The garment may be made entirely of the special fabric, or it may be provided only in certain selected areas of the garment to thereby float the wearer with face up so that it can cry out.

These and other objects, features and advantages of the invention will become apparent when the detailed description is studied with the drawings in which like reference numerals are applied to like elements in the various figures.

BRIEF DESCRIPTION OF THE DRAWINGS

FIG. 1 is a front elevation view, partially broken away, of a pellet of the invention.

FIG. 2 is a plan view, partially broken away, of a fabric of the invention.

FIG. 3 is a sectional view taken through line 3—3 of FIG. 2.

FIG. 4 is a plan view of another embodiment of the fabric of the invention, partially broken away.

FIG. 5 is a sectional view taken on line A—A of FIG. 4.

FIG. 6 is a sectional view taken on line A—A of FIG. 4 of another embodiment of the fabric of the invention.

FIG. 7 is s front elevation view of a garment of the invention.

FIG. 8 is a side elevation view of the garment of FIG. 7.

DETAILED DESCRIPTION OF PREFERRED EMBODIMENTS

Referring now first to FIG. 1, a preexpanded bead or pellet 2 is shown with a portion of its outer surface 4 broken away to reveal the closed cellular foam structure within. The beads are generally made of polystyrene plastic material. They are very inexpensive. They are produced in huge quantities for use in forming disposable cups and packaging, insulated chests and insulating board. They are produced by polymerization of styrene monomer with the inclusion of a heat vaporizing hydrocarbon blowing agent. When the beads are subjected to heat, such as steam, the blowing agent vaporizes and the bead expands to as much as 50 times its original density. These are called preexpanded beads or pellets. The internal structure of the bead is cells 3 each enclosed within a water-impermeable polystyrene wall 19, commonly termed a closed cell foam plastic. The bead itself is impermeable to water so that it retains its low density buoyancy when immersed in water. The individual preexpanded beads are free flowing and separate from one another. The maximum dimension 18 of the bead is less than one centimeter.

Referring now to FIGS. 2 and 3, a flotation fabric of the invention is shown, in which two opposed woven or knitted cotton fabric webs 5, 6 are cemented together by adhesive connecting means 13. Sandwiched between the cotton layers are preexpanded beads 2. The thickness of the webs 5, 6 are exaggerated for illustrative purposes. They are generally of the thickness of an ordinary T shirt. The combination of the webs with the beads produces a very buoyant fabric.

Because the pellets are not attached to one another, they do not stiffen the fabric excessively. The fabric is flexible enough to make a comfortable garment. The webs are water permeable. Although the pellets are water impermeable, the interstitial spaces 20 between individual pellets provide an adequate path for the passage of water either as liquid or vapor, so that the resulting fabric 1 "breathes" i.e. permits the passage of air and water vapor therethrough.

The adhesive 13 may be sprayed on a first web 6, the pellets blown onto the adhesive coated web, and then the second web 5 coated with adhesive and pressed onto the pellets to form the finished fabric 1.

Referring now to FIGS. 4 and 5, another embodiment of the invention is shown in which the pellets 2 are sandwiched between webs 5, 6 and then a heated tool, with a grid pattern much like a waffle iron, is pressed down on the combination. The heat and pressure applied along connecting lines 17 causes the pellets to melt and adhere to the cotton, providing a quilting like arrangement with pellets trapped within squares 21 so that they cannot all shift to the bottom of the garment. This substantially stabilizes the pellet configuration within the fabric while maintaining the flexibility and permeability of the fabric. Referring now to FIGS. 4 and 6, the connection of the two web layers 5, 6 may be accomplished by stitches 14 along the connecting lines 17 to produce the quilting pattern joining the webs and restraining the pellets 2 within the squares 21.

The pellets, beads, particles used herein may be any closed cell, water-impermeable material such as ground recycled foam packaging, polyurethane foam which may be sandwiched and flexibly immobilized between the webs. By keeping the particles small, the fabric retains flexibility. The webs may be of any woven or knitted fabric, natural or synthetic or combinations thereof.

Referring now to FIGS. 7, 8, a T-shirt type garment 22 having sufficient flotation to keep the wearer afloat with the head up is shown. A belt 23 holds the shirt down at the waist. A collar 24 may be made of multiple layers of fabric to provide extra buoyance at the head. The front half 25 of the shirt may have an extra layer of fabric 1 so as to ensure that the wearer will float face up.

Alternatively, the rear half 26 of the shirt may not be made of the buoyant fabric. Garments of the invention may take any of the configurations well known in the garment industry, such as jackets, coveralls and the like.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention.

What is claimed is:

1. A flexible, light weight, water-permeable flotation fabric comprising:

a plurality of pellets of water-impermeable closed cell foam plastic material, the pellets being unattached to one another and having a maximum straight line dimension of less than one centimeter;

a pair of opposed water-permeable fabric webs disposed at either side of the plurality of pellets; and connecting means for connecting the webs together and retaining the pellets therebetween flexibly immobilized in a substantially stable fabric configuration.

2. The fabric according to claim 1, in which the connecting means comprises stitches.

3. The fabric according to claim 1, in which the connecting means comprises adhesives.

4. The fabric according to claim 1, in which the plastic material includes polystyrene.

5. The fabric according to claim 4, in which the fabric webs are at least partially made of cotton.

6. The fabric according to claim 5 in the form of a garment adapted to maintain a wearer thereof in a safe floating position in water.

7. The fabric according to claim 1, in which the plastic material-includes polyurethane.

8. The fabric according to claim 7, in which the fabric webs are at least partially made of cotton.

9. The fabric according to claim 1, in which the fabric webs are at least partially made of cotton.

10. The fabric according to claim 1 in the form of a garment adapted to maintain a wearer in a safe floating position in water.

11. The fabric according to claim 1, in which the connecting means comprises heat sealing.

12. A flotation garment adapted to maintain a wearer thereof in a safe floating position in water, the garment constructed at least partially of a flotation fabric comprising:

a plurality of pellets of water impermeable closed cell foam plastic material, the pellets being unattached to one another and having a maximum straight line dimension of less than one centimeter;

a pair of opposed water-permeable fabric webs disposed at either side of the plurality of pellets; and connecting means for connecting the webs together and retaining the pellets therebetween flexibly immobilized in a substantially stable fabric configuration.

13. The garment according to claim 12, in which the connecting means comprises stitches.

14. The garment according to claim 12, in which the connecting means comprises adhesives.

15. The garment according to claim 12, in which the plastic material includes polystyrene.

16. The garment according to claim 12, in which the fabric webs are at least partially made of cotton.

17. The garment according to claim 12, in which the connecting means comprises heat sealing.

* * * * *